US009144826B2

(12) United States Patent
Prignon

(10) Patent No.: US 9,144,826 B2
(45) Date of Patent: Sep. 29, 2015

(54) SEPARATOR FOR GRANULAR MATERIALS

(75) Inventor: Xavier Prignon, Evelette (BE)

(73) Assignee: Magotteaux International S.A., Vaux-Sous-Chevremont (BE)

( * ) Notice: Subject to any disclaimer, the term of this patent is extended or adjusted under 35 U.S.C. 154(b) by 0 days.

(21) Appl. No.: 14/343,327

(22) PCT Filed: Sep. 12, 2012

(86) PCT No.: PCT/EP2012/067825

§ 371 (c)(1),
(2), (4) Date: Jun. 2, 2014

(87) PCT Pub. No.: WO2013/037820

PCT Pub. Date: Mar. 21, 2013

(65) Prior Publication Data

US 2014/0251878 A1 Sep. 11, 2014

(30) Foreign Application Priority Data

Sep. 14, 2011 (BE) ..... 2011/0547

(51) Int. Cl.
*B07B 7/10* (2006.01)
*B07B 7/083* (2006.01)
*B07B 4/06* (2006.01)

(52) U.S. Cl.
CPC ... *B07B 7/10* (2013.01); *B07B 4/06* (2013.01); *B07B 7/083* (2013.01)

(58) Field of Classification Search
CPC ..... B07B 4/00; B07B 4/02; B07B 4/04; B07B 7/10; B04C 5/04; B04C 5/06; B04C 5/08; B04C 9/00
USPC ..... 209/138, 139, 715, 721
See application file for complete search history.

(56) References Cited

U.S. PATENT DOCUMENTS 4,551,241 A 11/1985 Saverse et al.
2007/0163925 A1 * 7/2007 Prignon ..... 209/143

FOREIGN PATENT DOCUMENTS

DE 19743491 A1 4/1998
EP 0023320 2/1981
EP 2266715 A1 12/2010
GB 1221754 A * 2/1971
WO WO 2005/075115 A1 8/2005

OTHER PUBLICATIONS

Machine translation of Konetzka et al., DE 102009030396 A1, retrieved Mar. 22, 2015.*

* cited by examiner

*Primary Examiner* — Michael McCullough
(74) *Attorney, Agent, or Firm* — Reinhart Boerner Van Deuren P.C.

(57) ABSTRACT

A dynamic air separator for separating materials consisting of particles of different sizes into particle-size fractions. The separator includes a rotary housing and a chamber for recovering the fine particles, which is coaxially arranged in alignment with the rotary housing. The separator also includes a fan wheel positioned coaxially to the chamber for recovering the fine particles. The fan wheel is located at the end of the outlet duct for purified air from the chamber for recovering the fine particles, in order to suck in air during use and send the latter to the air-distribution chamber around the rotary housing.

15 Claims, 8 Drawing Sheets

SEPARATOR FOR GRANULAR MATERIALS

SUBJECT OF THE INVENTION

The present invention relates to an industrial station for separating granular materials, and in particular for classifying powders or similar materials with dynamic air separators.

STATE OF THE ART

The separation of materials into particle fractions with different sizes may be done by means of dynamic air separators. The concerned materials are powders with particle sizes of up to 1000 μm, such as cement, limestone or lime, ore and coal among others.

Dynamic separators have undergone several major evolutions allowing them to be classified in 3 major families. The first, generally known under the names "turbo", "heyd" or "whirlwind", was improved by a second called "Wedag" type. These separators may optionally have a cage instead of the selection blades.

Document EP2266715A1 (Hosokawa) discloses a separator where the material is not supplied and dispersed above, but below the cage or selection blades. Furthermore, the fan is not at the outlet of the purified air duct, but on the contrary it receives the air charged with material.

The latest generation of separators that has been developed is the most compact and highest performing in terms of separation efficiency. The operating principle of this type of separator is in particular described in documents U.S. Pat. No. 4,551,241 and EP 0023320 A1.

Document DE 19743491 (Schmidt) discloses three types of separators, focusing on the cage thereof. It discloses a so-called first-generation separator (Kompaktsichter), a so-called second-generation separator (Zyklonumluftsichter) and a so-called third-generation separator (Querstromsichter). In these separators, the fan and the cyclone are outside the separator. No compactness of the installation is sought.

Document U.S. Pat. No. 4,551,241 discloses a particle separator provided with a lateral cyclone in which the fine particles are sent with the air toward cyclones to be recovered. The fine particles that have not been cycloned are sent back to the rotary cage of the separator. The whole installation turns out to be relatively bulky and to have a fairly complex design.

Document WO 2005/075115 describes a device for classifying granular materials with the particularity of having a chamber for cycloning the fine fraction in the extension of the axis of the rotary cage. This recovery chamber arranged coaxially to the rotary cage is part of the body of the separator. This type of air separator thereby does not require an outside cyclone or filter to separate the fine material from the separation air. The recovery chamber benefits from the air vortex created by the cage for the cycloning. The fan that sucks the air in at the outlet of the separator and discharges it toward the air intake volute of the separator is, however, positioned outside the installation, which creates a significant bulk. Furthermore, the air must be distributed through a volute still designed for a predetermined air flow rate. It therefore does not allow optimal operation when the air flow rate varies.

All of the types of separators of the state of the art operate according to the same principle as shown in FIGS. 1 to 6. The core of the separator is made up of a squirrel cage rotating around a vertical axis. This cage is made up of strips or bars spaced apart and is surrounded by vanes making it possible to guide the air coming from the air distribution chamber of the separator before entering the cage. The material to be separated arrives in the selection area delimited by the outside of the cage and the deflectors. The maximum size of the particles entering the cage with the air is determined by the rotation speed of the cage and the quantity of air with which the separator is supplied. The larger particles remain outside the cage and are recovered in the bottom of the recovery chamber of the coarse fraction. The fine particles enter the cage with the air. This air charged with fine particles is then oriented toward the air/material separating means in order to collect the material. These means may be cyclones or filters outside the separator or then—as described in WO 2005/075115—in a fine particle recovery chamber integrated into the separator, adjacent and coaxial to the cage. The cycloned or filtered air is then sucked in toward a fan and returned in whole or in part to the air distribution chamber of the separator. In general, this air distribution chamber consists of a spiral-shaped volute centered on the cage of the separator. It is, however, difficult to distribute the air uniformly at 360° around the cage. In fact, the air distribution depends on the shape of the volute, as well as on the air speed and flow rate. Further, deposits of material may appear in the volute, which prevents a uniform distribution of the air and therefore a good separating efficiency.

AIMS OF THE INVENTION

The present invention aims to disclose a dynamic air separator with a rotary cage making it possible to avoid the use of an outside fan. The fan is integrated into the body of the separator, which makes it possible to improve the air distribution on the perimeter and height of the cage, and thus to produce a homogenous air flow preventing the segregation of the particles in the dead areas.

The separator according to the present invention also aims to reduce the overall bulk of the installation and to make it possible to install a high-performance separator in tight spaces where it was not previously possible to do so.

SUMMARY OF THE INVENTION

The present invention discloses a dynamic air separator for separating materials made up of particles of different sizes into particle-size fractions, said separator comprising a rotary cage and a fine particle recovery chamber arranged coaxially in the extension of the rotary cage, characterized in that:

- said separator comprises a fan wheel positioned coaxially to the fine particle recovery chamber;
- said fan wheel is located at the end of the purified air outlet duct coming from the fine particle recovery chamber so as to suck in, in use, that air and send it toward the air distribution chamber around the rotary cage.

According to specific embodiments, the invention comprises at least one or a suitable combination of the following features:

- the air distribution chamber around the rotary cage has a shape of revolution;
- the fan wheel is surrounded by an enclosure making it possible to channel the air;
- said enclosure surrounding the fan wheel is positioned coaxially to the separator;
- the fan wheel is located above or below the rotary cage;
- said enclosure surrounding the fan wheel is connected to the air distribution chamber around the rotary cage by a ferrule.

DETAILED DESCRIPTION OF THE INVENTION

Figure 1:
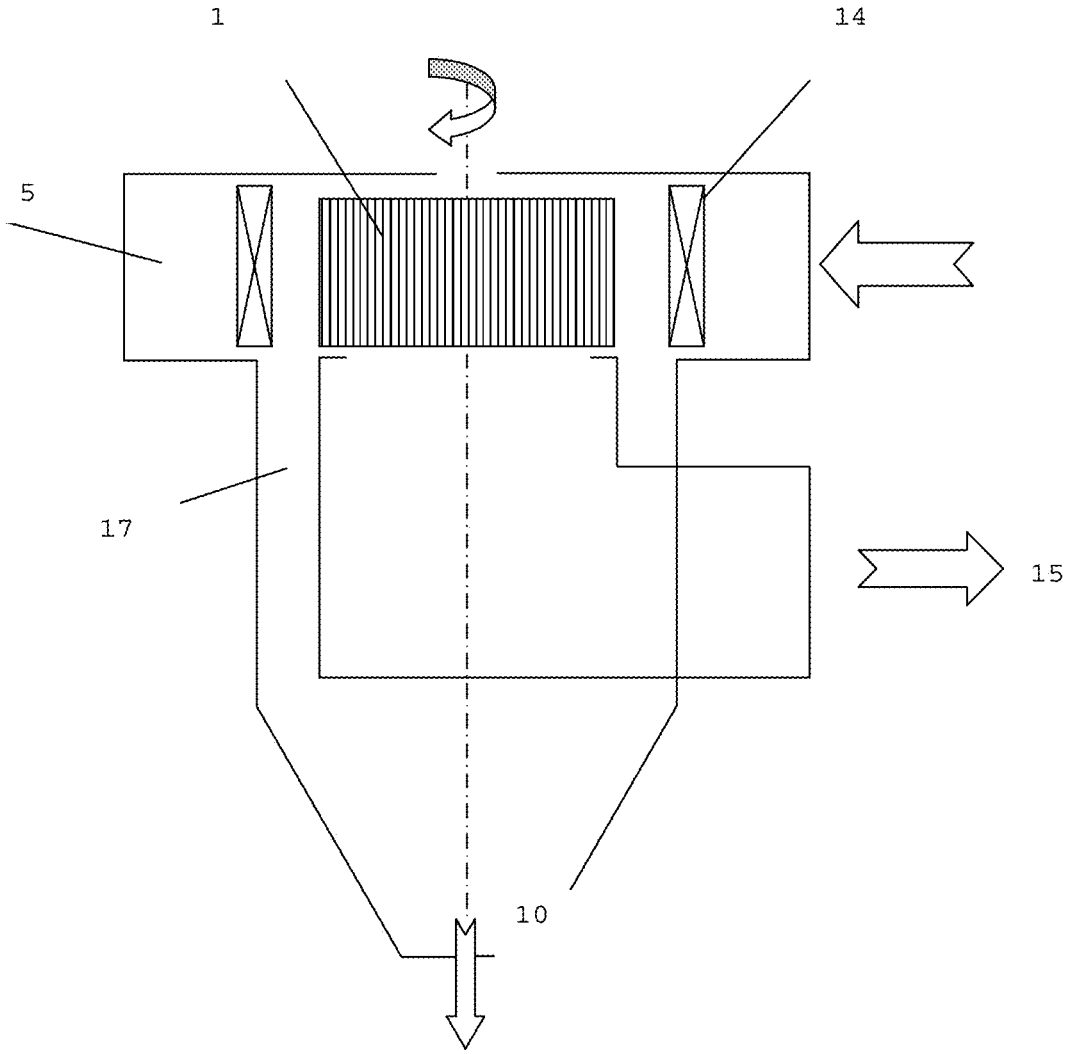
Figure 1 (Prior Art)
FIG. 1 shows a diagram of a separator according to the state of the art with a rotary cage separator operating with cyclones and external fans.
Figure 2:
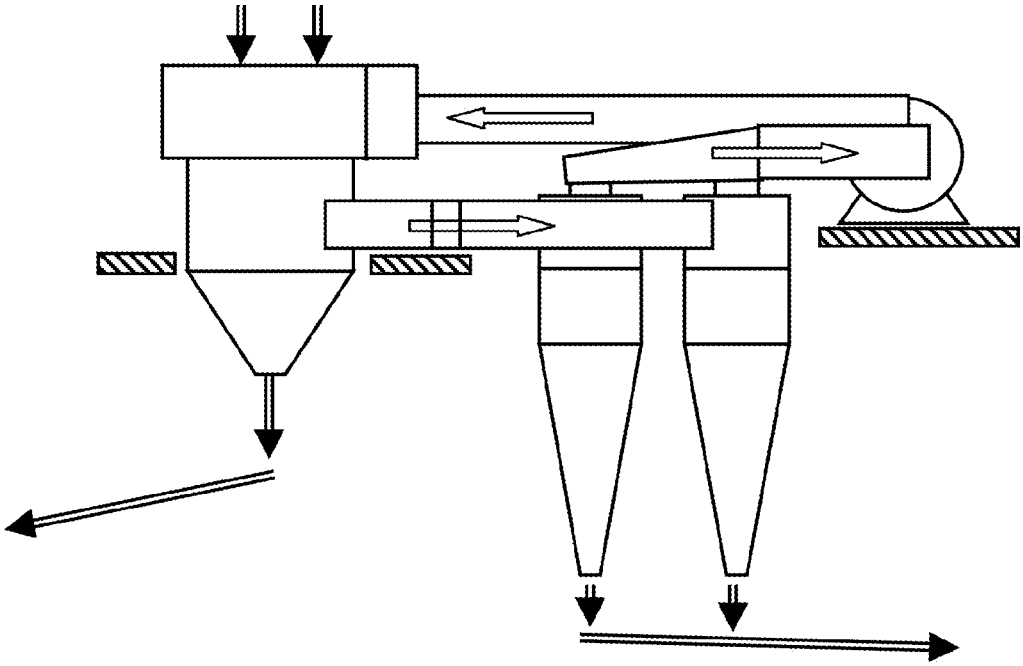
FIG. 2 shows a complete installation according to the state of the art, the operation of which is diagrammed in FIG. 1.
Figure 3:
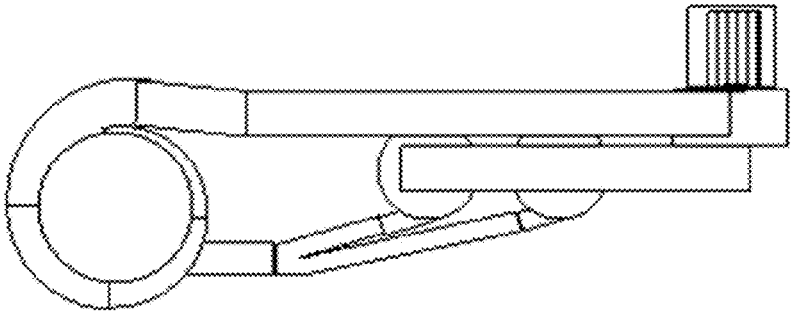
FIG. 3 shows a plan view of the installation of FIG. 2. In this type of installation, the cyclones and the fans are outside the separator.
Figure 4:
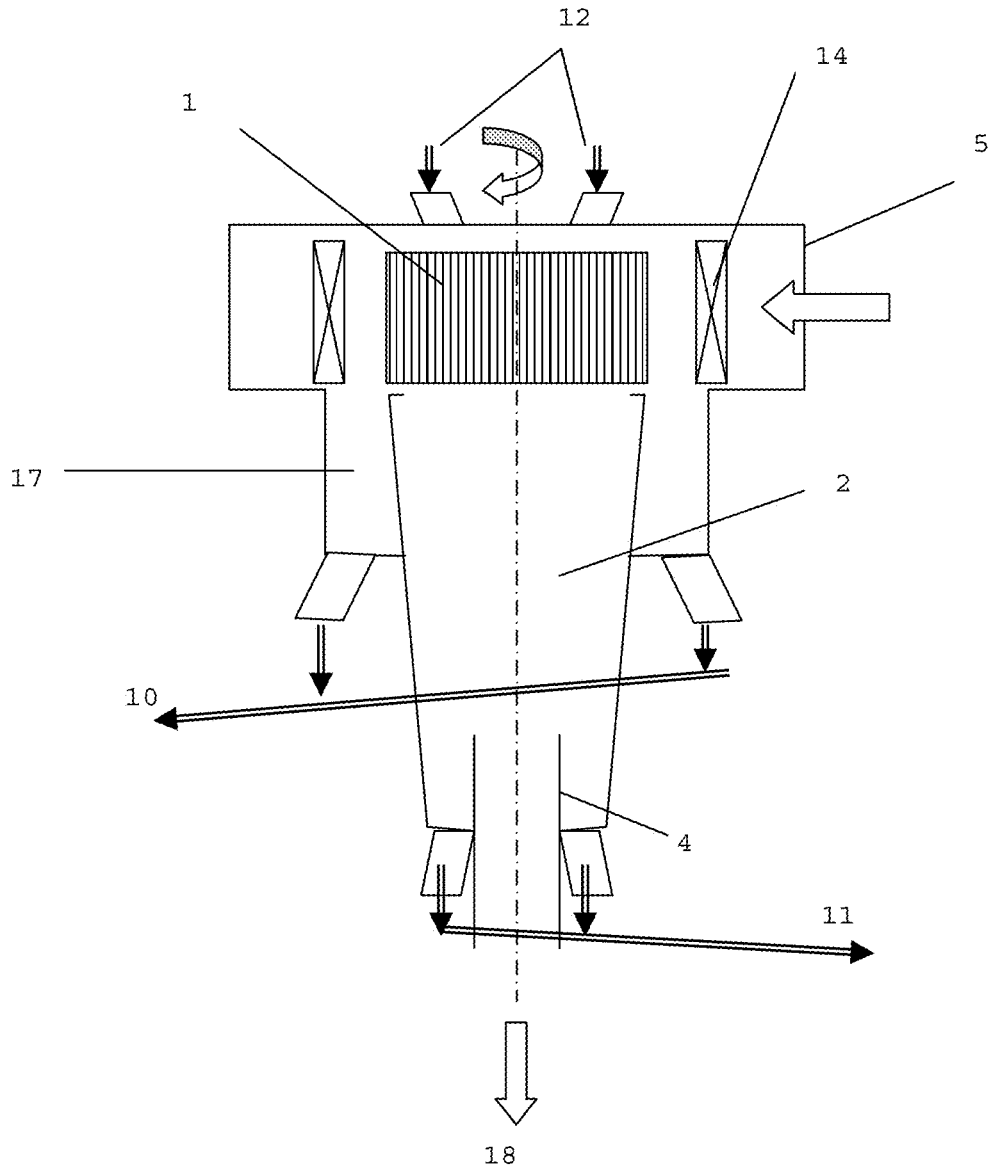
FIG. 4 shows a diagram of the separator disclosed in document WO 2005/075115; the separator incorporates a rotary cage with cycloning of the fine particles arranged coaxially to the cage.
Figure 5:
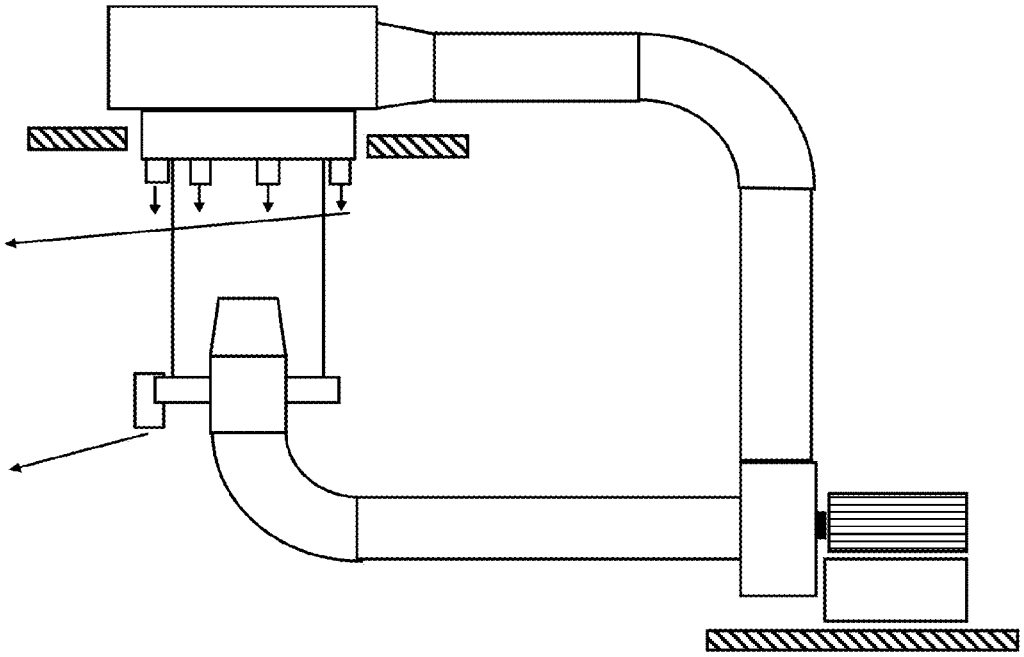
FIG. 5 shows a complete installation according to the state of the art WO 2005/075115 with its external elements.
Figure 6:
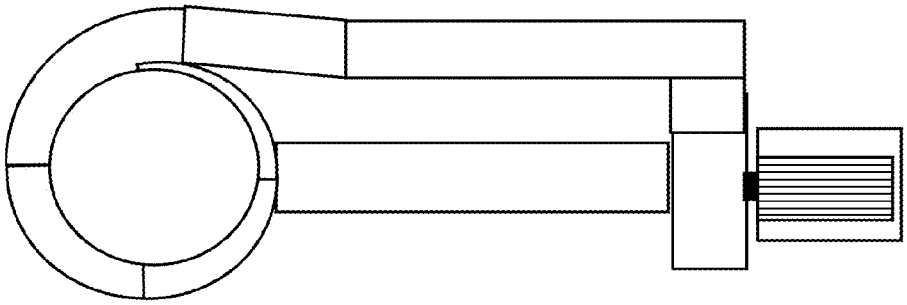
FIG. 6 shows a plan view of the installation of FIG. 5. In this type of installation, the cycloning has been integrated into the separator and only the fans are still outside the separator.
Figure 7:
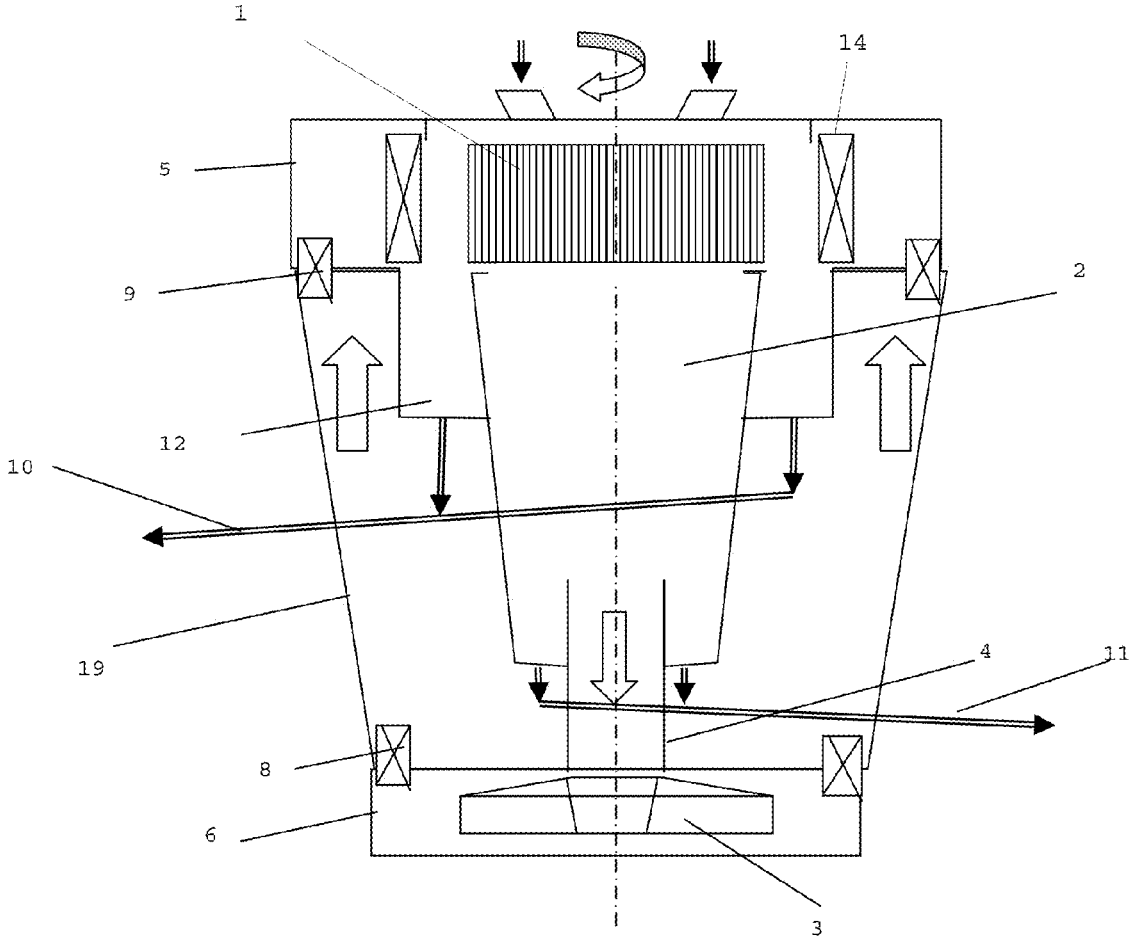
FIGS. 7 and 8 show a cross-sectional view of the operating principle of a separator according to a first and second embodiment of the invention. Here, the cyclone AND the fan have been integrated into the separator.

The principle of separating the particles in the installation according to the invention is diagrammed in FIGS. 7 to 10.

The separator according to the invention comprises a fine particle recovery chamber 2 adjacent and arranged coaxially in the extension of the rotary cage 1, said recovery chamber 2 being provided at one of its ends with a coaxial outlet duct 4 for the purified air, said duct comprising at its end a fan wheel 3. Said fan wheel 3 is positioned coaxially to the rotary cage 1 and the fine particle recovery chamber 2.

The fan wheel 3 is driven by a motor, the speed of which will be adapted to the pressure loss in the separator.

Between the recirculation enclosure of the fan 6 and the air distribution chamber 5 at the inlet of the separator, multiple ducts 7 (see FIG. 9) may be installed that make it possible to recirculate the air from the fan toward the air distribution chamber 5 around the rotary cage 1 of the separator. These ducts 7 will be distributed uniformly over 360° around the axis of the separator.

Due to the uniform distribution of the air recirculation ducts 7 on the perimeter of the air distribution chamber 5, the recirculation air is uniformly distributed around the cage 1 of the separator. As a result, the cutoff size (separating point of the particle sizes) of the separator is constant over the entire circumference of the separator cage.

One particular embodiment of the invention consists of replacing the multiple ducts 7 with a single outer ferrule 19 made up of a surface of revolution—of a generally cylindrical or conical design—the diameter of which is comprised between the diameter of the enclosure of the fan 6 and the outside diameter of the air distribution chamber 5 around the cage. In that case, it is preferable to install, in the transition area between the enclosure of the fan 6 and the ferrule 19, deflectors 8 making it possible to convert the tangential speed of the air at the outlet of the fan wheel 3 into a vertical speed. Likewise, it may be useful to install deflectors 9 at the junction between the ferrule 19 and the air distribution chamber 5 so as to impart the desired direction to the air in the air distribution chamber 5. As a result, it is also possible to influence the distribution of the air over the height of the air distribution chamber and the height of the cage. This therefore makes it possible to obtain a constant cutoff size over the entire height of the cage, which is very difficult to obtain with a traditional volute.

Figure 8:
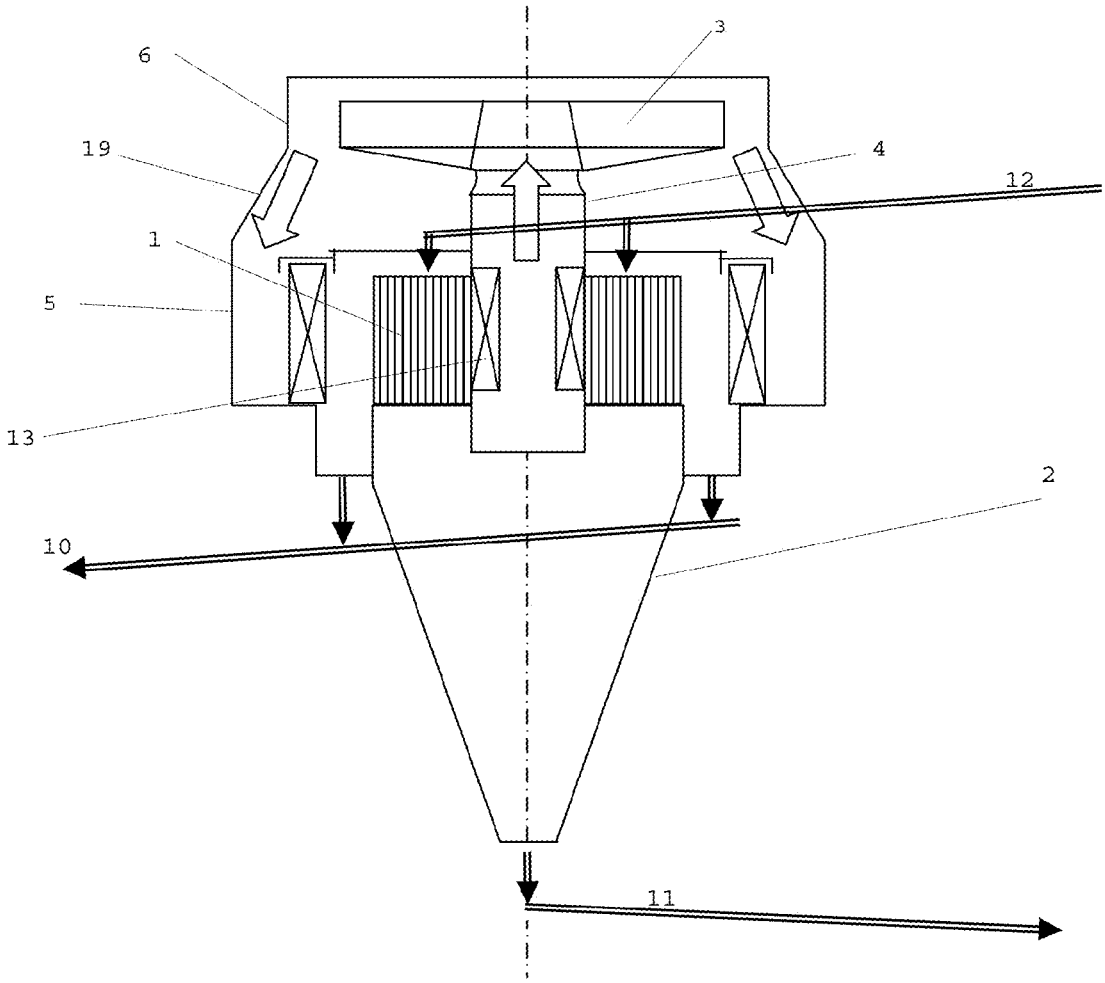
Figure 9:
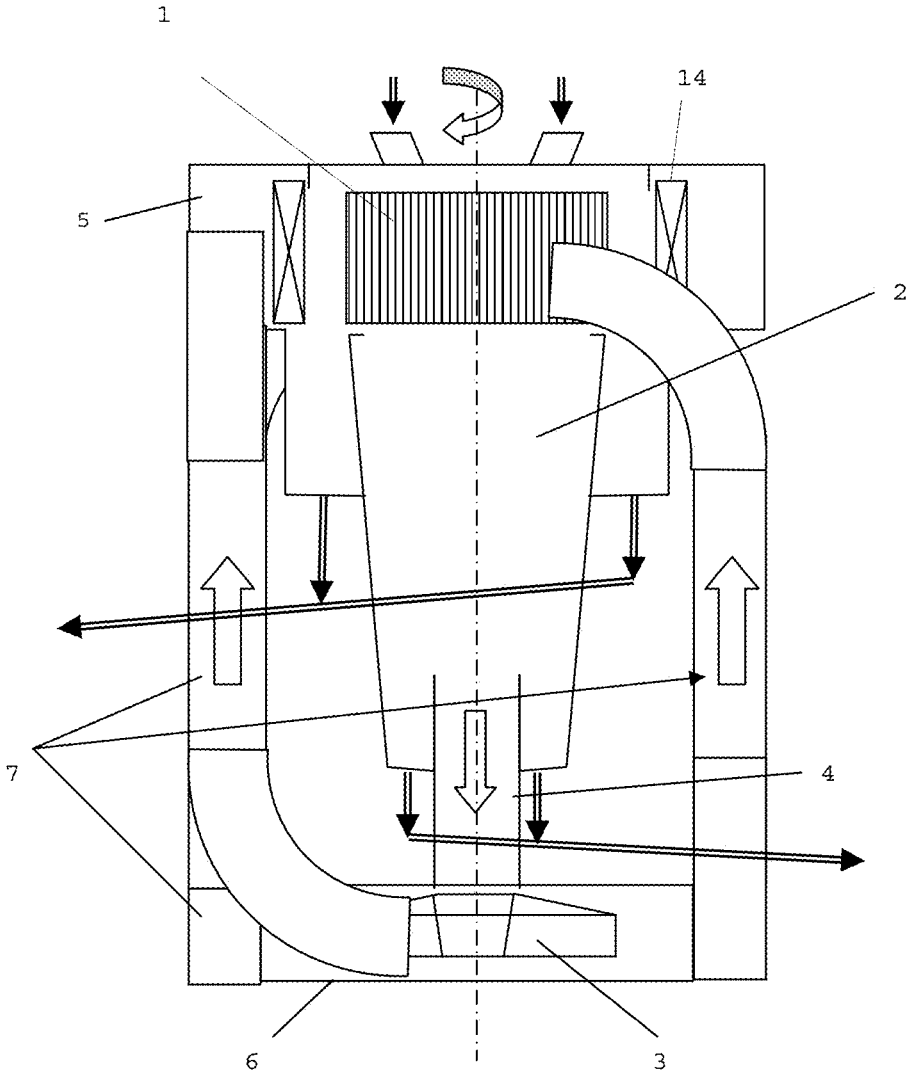
FIG. 9 shows the first embodiment of the invention in its immediate environment with the air recirculation ducts. The separator is very compact.
Figure 10:
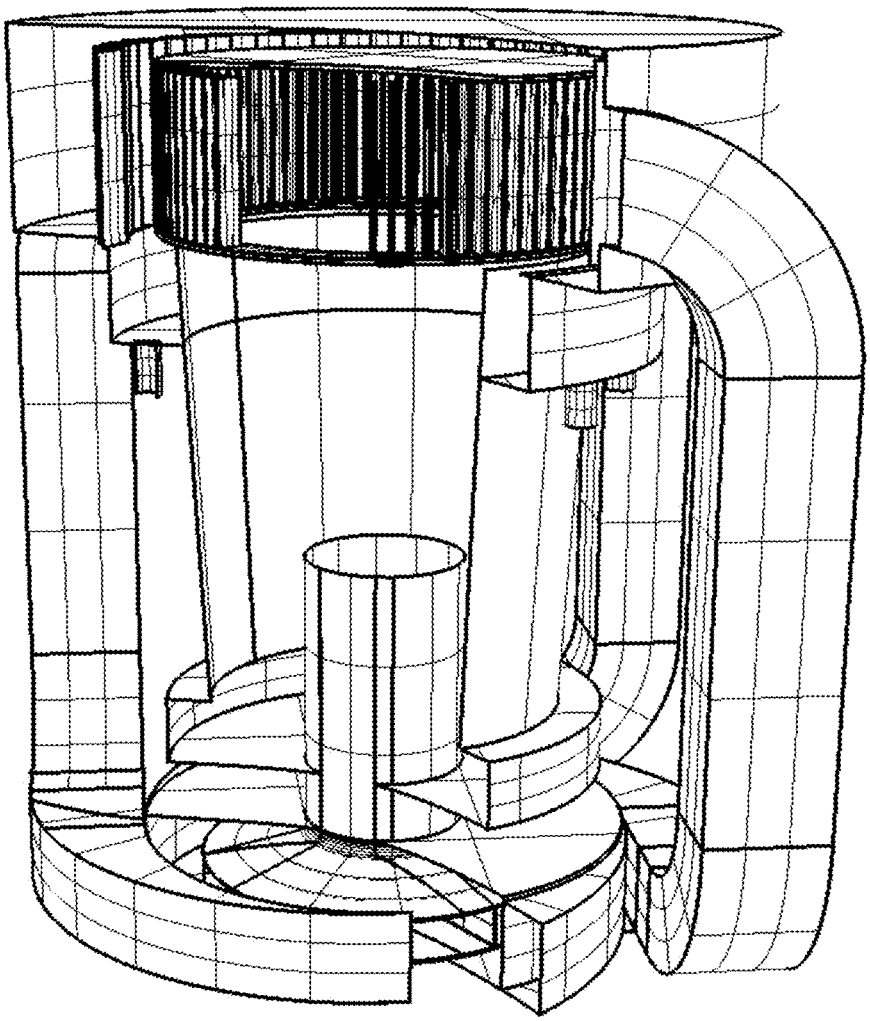
FIG. 10 shows the first embodiment of the invention in three dimensions.

FIG. 8 shows another possible embodiment of the invention. The fan wheel 3 is positioned coaxially to the separator at the end of the purified air outlet duct 4, as in the first embodiment of the invention, but this time the fan wheel 3 is positioned above the cage 1 of the separator. The fine particle recovery chamber 2 is located below the rotary cage 1. However, the purified air outlet duct 4 enters the upper part of the fine particle recovery chamber and passes through the rotary cage 1. Advantageously, said duct 4 is equipped with anti-vortex deflectors 13 to decrease the speed of rotation of the air before emerging in the fan wheel 3 located at its end.

In the embodiment of the invention where the fan wheel 3 is located above the cage 1, recirculation through the ferrule 19 will be preferred. Said ferrule will have the form of a surface of revolution centered on the axis of the separator and will connect the enclosure of the fan 6 to the air distribution chamber 5. In that same case, the size of the ferrule 19 could be much smaller if the enclosure of the fan 6 and the air distribution chamber 5 are positioned near one another.

LEGEND

1. Rotary cage
2. Fine particle recovery chamber
3. Fan wheel
4. Purified air outlet duct
5. Air distribution chamber (in the form of a volute in the prior art and in the form of revolution in the separator according to the invention)
6. Fan enclosure
7. Air recirculation duct
8. Fan outlet deflector
9. Inlet deflector in the air distribution chamber
10. Coarse fraction of the material separated by gravity
11. Fine fraction of the material
12. Material to be treated
13. Anti-vortex deflector
14. Air distribution deflector around the cage
15. Air charged with fine particles
16. Air recirculation ducts
17. Recovery chamber for the coarse fraction of the material
18. Cycloned air
19. Ferrule

The invention claimed is:

1. A dynamic air separator for separating materials made up of particles of different sizes into particle-size fractions, said separator comprising a rotary cage above which the material to be treated is supplied and a fine particle recovery chamber arranged coaxially in an extension of the rotary cage, characterized in that:

said separator comprises a fan wheel positioned coaxially to the rotary cage and the fine particle recovery chamber;

said fan wheel is located at an end of purified air outlet duct coming from the fine particle recovery chamber so as to suck in, during use, that air and send it toward an air distribution chamber around the rotary cage.

2. The separator according to claim 1, characterized in that the air distribution chamber around the rotary cage has a shape of revolution.

3. The separator according to claim 2, characterized in that said fan wheel is surrounded by an enclosure making it possible to channel the air.

4. The separator according to claim 2, characterized in that the fan wheel is located above the rotary cage.

5. The separator according to claim 2, characterized in that the fan wheel is located below the rotary cage.

6. The separator according to claim 2, characterized in that said enclosure surrounding the fan wheel is connected to the air distribution chamber around the rotary cage by a ferrule.

7. The separator according to claim 1, characterized in that said fan wheel is surrounded by an enclosure making it possible to channel the air.

8. The separator according to claim 7, characterized in that the fan wheel is located below the rotary cage.

9. The separator according to claim 7, characterized in that the fan wheel is located above the rotary cage.

10. The separator according to claim 7, characterized in that said enclosure surrounding the fan wheel is connected to the air distribution chamber around the rotary cage by a ferrule.

11. The separator according to claim 1, characterized in that the fan wheel is located above the rotary cage.

12. The separator according to claim 11, characterized in that said enclosure surrounding the fan wheel is connected to the air distribution chamber around the rotary cage by a ferrule.

13. The separator according to claim 1, characterized in that the fan wheel is located below the rotary cage.

14. The separator according to claim 13, characterized in that an enclosure surrounding the fan wheel is connected to the air distribution chamber around the rotary cage by a ferrule.

15. The separator according to claim 1, characterized in that an enclosure surrounding the fan wheel is connected to the air distribution chamber around the rotary cage by a ferrule.

* * * * *

UNITED STATES PATENT AND TRADEMARK OFFICE

CERTIFICATE OF CORRECTION

PATENT NO. : 9,144,826 B2
APPLICATION NO. : 14/343327
DATED : September 29, 2015
INVENTOR(S) : Xavier Prignon It is certified that error appears in the above-identified patent and that said Letters Patent is hereby corrected as shown below:

In the claims:

Col. 4, line 46, claim 1, the line should read: said fan wheel is located at an end of a purified air outlet duct Signed and Sealed this
Twelfth Day of July, 2016

Michelle K. Lee

Michelle K. Lee
*Director of the United States Patent and Trademark Office*